US005819348A

United States Patent [19]

Ryan

[11] Patent Number: 5,819,348

[45] Date of Patent: Oct. 13, 1998

[54] MODULAR MATERNITY MATTRESS WITH INFLATABLE ABDOMINAL SUPPORT

[76] Inventor: Denise Ryan, 220 East 84th St. 4D, New York, N.Y. 10028

[21] Appl. No.: 698,024

[22] Filed: Aug. 15, 1996

[51] Int. Cl.[6] ..... A47C 27/18

[52] U.S. Cl. ..... 5/735; 5/722; 5/723; 5/930

[58] Field of Search ..... 5/735, 930, 631, 5/710, 722, 723, 922

[56] References Cited

U.S. PATENT DOCUMENTS

| | | | |
|---|---|---|---|
| 1,548,728 | 8/1925 | Milam | 5/930 |
| 4,021,872 | 5/1977 | Powell | 5/735 |
| 4,397,052 | 8/1983 | Lund, III | 5/930 |
| 4,737,999 | 4/1988 | Halverson | 5/735 |
| 4,819,287 | 4/1989 | Halverson | 5/735 |
| 5,185,897 | 2/1993 | Van Laanen | 5/735 |
| 5,237,712 | 8/1993 | Ramsay | 5/735 |
| 5,369,824 | 12/1994 | Powell | 5/735 |
| 5,400,449 | 3/1995 | Satto | 5/930 |
| 5,412,824 | 5/1995 | Emerson et al. | 5/930 |
| 5,425,147 | 6/1995 | Supplee et al. | 5/930 |
| 5,504,953 | 4/1996 | Singer-Leyton et al. | 5/930 |

FOREIGN PATENT DOCUMENTS

| | | | |
|---|---|---|---|
| 2826074 | 12/1979 | Germany | 5/631 |

*Primary Examiner*—Alexander Grosz

[57] ABSTRACT

A modular, adjustable maternity mattress designed to accommodate a pregnant woman at rest in a prone or side lying position; comprised of a sectioned base cushion and corresponding relocatable upper cushions as a head cushion, an inflatable abdominal cushion, and a leg cushion. The sectioned base cushion is shaped as a thin conventional mattress and is slightly longer than the overall length of the head, inflatable abdominal, and leg cushions joined end to end. The head and leg cushions are thick, flat, and generally squared, with wedge shaped medial ends (relative to the centrally located inflatable abdominal cushion) that slope downward and inward towards the base cushion and inflatable abdominal cushion respectively. In the preferred embodiment, the inflatable abdominal cushion is composed of a series of vertically tiered independently inflatable cells, the overall lengths of which increase as they ascend, and each cell having an inflator inlet and deflator outlet. The inflatable abdominal cushion, having contours that conform to the medial ends of the head and leg cushions where they interface otherwise contacts the base cushion surface, therefore having no lateral boundaries. When the inflatable abdominal cushion is deflated, a graduated, trough like, open sided abdominal outlet is formed. The length of the abdominal outlet is adjusted by relocating the head and leg cushions on the base cushion, and the depth of the abdominal outlet is adjusted via the degree of inflation of the inflatable abdominal cushion. The abdominal outlet provided is within a level surfaced mattress.

1 Claim, 2 Drawing Sheets

MODULAR MATERNITY MATTRESS WITH INFLATABLE ABDOMINAL SUPPORT

BACKGROUND—FIELD OF THE INVENTION

The present utility pertains to bedding and body support cushions, and more particularly to a modular adjustable maternity mattress that accommodates a pregnant woman at rest in a prone or side lying position.

BACKGROUND—DESCRIPTION OF PRIOR ART

As a woman's pregnancy advances, her ability to rest comfortably on a conventional mattress diminishes. When considering a mattress design for a pregnant woman, one must allow for tolerance and support of the growth and the shape changes of the abdomen. It is important to note that the pregnant woman's abdomen expands not only frontally, but laterally as well. A maternity mattress must also have tolerance for the natural movement of the pregnant woman at rest, and the movement of the foetus. The upper and lower abdomen are naturally limited by the rib cage and pelvis respectively, therefore shape changes that can occur to the pregnant woman's upper and lower abdomen from hour to hour due to foetal movement are not as great as those that can occur frontally or laterally. It follows then, that the main structures of support for a maternity mattress correspond to her frame. In further developing an outline of the qualities desirable to a maternity mattress, one must give attention to the lateral expansion of the pregnant woman's abdomen and how that can make the side lying position more difficult. As the foetus grows, its mother's viscera are pushed upwards. It is not uncommon that lateral aspects of the pregnant woman's abdomen extend beyond her pelvis, and lacking accommodation at rest on the surface of a horizontal plane, the pelvis must tilt downward incurring a lateral hyperextension of the lumbar vertebrae. This would suggest the need for some accommodation. Quite another feature to be desired in relation to adjustability for a side lying position is a supportive procedure for a pregnant woman to access a prone position in a safe and comfortable manner. U.S. Pat. No. 5,237,712 issued Aug. 3, 1993 to Ramsay entitled "Maternity Mattress With Inflatable Portion", describes a mattress with a close sided cylindrical cavity containing inflatable cells. U.S. Pat. No. 5,425,147 issued June 1995 to Supplee et al, describes a fully inflatable mattress consisting of three concentric cuboid inflatable cells with vertical side walls, which whether common or not will all lose structure somewhat when any or all of the cells are deflated to whatever degree, and will subsequently collapse. U.S. Pat. No. 5,412,824 issued May 1995 to Emerson et al describes a mattress having two close sided cavities, one being cylindrical, the other being ellipsoidal, with each containing inflatable cells, as receptacles for the abdomen and breasts respectively. Also described is a sloping lower portion of the mattress, ostensibly configured to facilitate access to the prone position. This portion of the mattress is intended to support the pelvis and legs of the user; however , the downward angle would incur a reverse tilt of the lumbar sacrum joint that could prove injurious. Though this design attempts to provide a pregnant woman facilitated access to a prone position, she still must somehow lower her abdomen into a cavity. U.S. Pat. No. 4,737,999 issued April 1988 and U.S. Pat. No. 4,819,287 issued April 1989 both to Halverson each describe yet two more mattress having close sided cylindrical cavities containing inflatable cells. U.S. Pat. No. 5,369,824 issued December 1994 to Powell describes a mattress having a close sided cylindrical cavity containing a series of removable cushions. U.S. Pat. No. 4,021,872 issued May 1977 to Powell describes a reversible side mattress with each side having a close sided spherical cavity containing a series of removable cushions. U.S. Pat. No. 5,400,449 issued May 1995 to Satto describes a mattress having two pairs of cavities placed at opposite ends, one cavity being cuboid and the other cylindrical as receptacles for the breasts and the abdomen respectively. Again, the cavities are close sided, and contain a series of removable cushions. U.S. Pat. No. 5,404,953 issued April 1996 to Singer-Leyton et al describes a cushion support for a pregnant woman during massage having a close sided ellipsoidal cavity with a series of removable cushions. U.S. Pat. No. 5,185,897 issued February 1993 to Van Laanen describes an inflatable mattress with a close sided cylindrical cavity with a separate inflatable cell. None of the prior art cited provide adaptations for a pregnant woman to rest sidelying. None of the prior art cited provide tolerance for the movement of the pregnant woman at rest and the movement of the foetus, as all of their abdominal outlets are close sided. Finally, none of the prior art cited provide for a supported safe and comfortable means for a pregnant woman to access the prone position.

SUMMARY OF THE INVENTION

The present invention is a mattress designed for pregnant women that provides an abdominal outlet the length and depth of which is adjustable to the user's dimensions; a mattress that maintains a level surface, and is supportive while giving tolerance for movement of the pregnant woman and the foetus. The present invention is useful in accommodating a pregnant woman at rest in a prone or side lying position. The user can access the prone position in a supported safe and comfortable manner by gradually deflating the inflatable abdominal cushion while resting on the mattress in the side lying position and then slowly turning into the prone position. The present invention is modular and can be disassembled for more convenient storage. The present invention is relatively simple in its design, its component parts and the materials required for construction that it can be rendered economically.

DETAILED DESCRIPTION OF THE INVENTION

Figure 1:
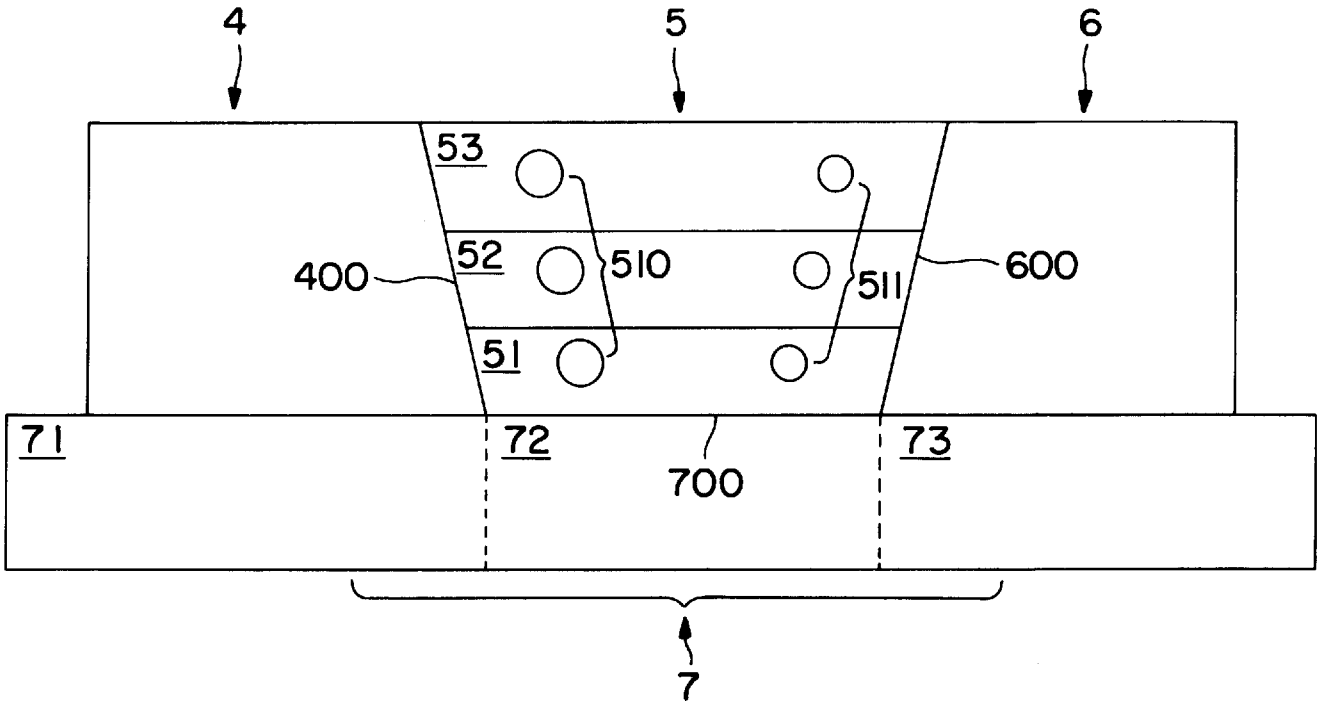
FIG. 1 represents a full side view of the invention.
Figure 2:
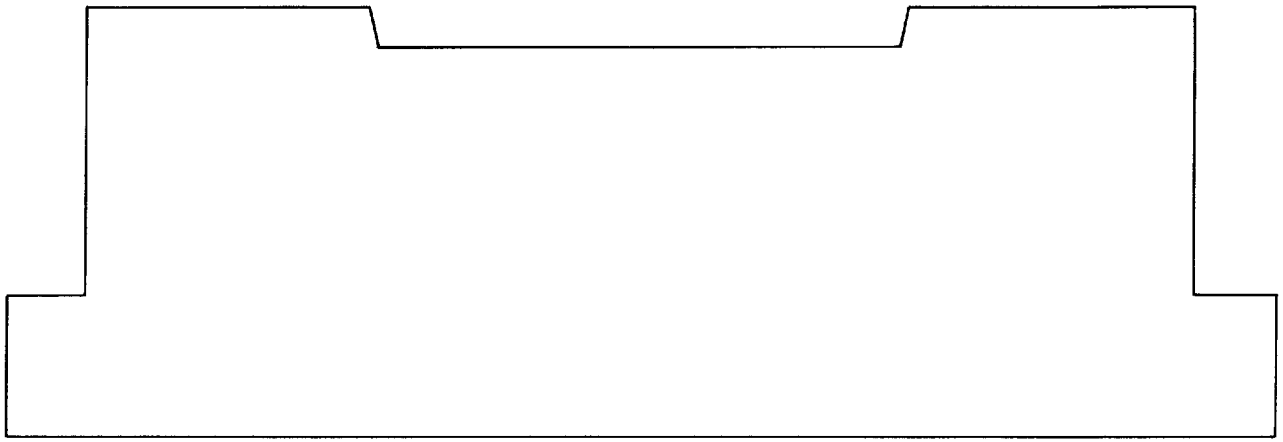
FIG. 2 represents a contour image of a side view of the invention with the inflatable abdominal cushion partially deflated to demonstrate a shallow abdominal outlet.
Figure 3:
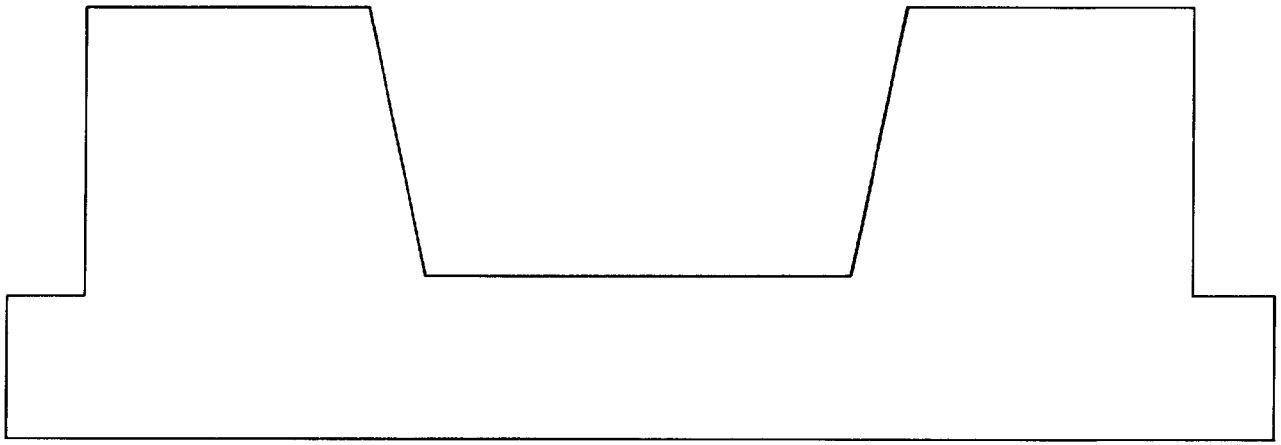
FIG. 3 represents a contour image of a side view of the invention with the inflatable abdominal cushion fully deflated to demonstrate a deep abdominal outlet.

The modular adjustable maternity mattress depicted in FIG. 1 comprises a head cushion 4, an inflatable abdominal cushion 5, a leg cushion 6, and a base cushion 7. The base cushion is sectioned 71, 72, 73, in correspondence with the upper cushions 4, 5, 6. The materials for construction of the base 7, head 4, and leg 6 cushions may be a combination of high and medium density polyurethane foam, however any suitable mattress material will do, preferably with soft upper layering. The inflatable abdominal cushion 5 in a preferred embodiment consists of a vertically tiered series of inflatable cells, 51, 52, 53, with inflator inlets and deflator outlets depicted in their possible positioning at 510, 511, respectively. Each cell 51, 52, 53, of the inflatable abdominal cushion 5 would have an inflator inlet 510 and a deflator outlet 511. The inflatable abdominal cushion could as well be composed of a single or any number of cells 5, 51, 52, 53. Here outlined thus far as the components of the maternity mattress are a head cushion 4, an inflatable abdominal cushion 5, a leg cushion 6, and a base cushion 7. The design of this maternity mattress is not limited to this number of cushions or sections. Each cushion 4, 5, 6, may be enclosed in a suitable fabric and fastened to its corresponding base cushion section 71, 72, 73, by a removeable fastener such as Velcro. The base cushion sections 71, 72, 73, may also be enclosed in a suitable fabric and secured to each other edge to edge at their underside surfaces so that the unit 7 can be folded for storage purposes. The abdominal outlet, FIG. 2, FIG. 3, is created by deflating partially FIG. 2, or fully, FIG. 3, any or all of the cells of the inflatable abdominal cushion 5. The head and leg cushions 4, 6, are wedge shaped at their medial ends 400, 600, with the inflatable abdominal cushion 5 having contours that complement the head and leg cushions' ends 400, 600, thereby the abdominal outlet that forms FIG. 2, FIG. 3, is graduated, being somewhat narrower where it meets the base cushion surface 700 than at its upper surface. The abdominal outlet is open sided, FIG. 2, FIG. 3, as it is interfaced on three sides only; the medial ends of the head and leg cushions 400, 600, and the upper surface of the corresponding base cushion 700. The length of the abdominal outlet FIG. 2, FIG. 3, can be changed by relocating the head cushion 4, and/or the leg cushion 6, on the base cushion 7. A fitted sheet with an elastic (such as Spandex) center section may be employed to add non-restrictive lateral support to the abdominal area as a comfort feature.

I claim:

1. A modular adjustable maternity mattress comprising a segmented base cushion having an upper surface and corresponding relocatable upper cushions arranged consecutively on the upper surface of said base cushion, as a head cushion, an inflatable abdominal cushion, and a leg cushion, with the head and leg cushions' medial ends relative to the inflatable abdominal cushion sloping downward and inward towards the base cushion's upper surface and the inflatable abdominal cushion respectively, and the inflatable abdominal cushion having contours that complement the sloping ends of the head and leg cushions where they interface defining the two boundaries of the inflatable abdominal cushion aside from the base cushion section upon which it rests, such that, relative to the positioning of the upper cushions upon the base cushion, deflation of the inflatable abdominal cushion forms an open sided, graduated, trough like abdominal outlet of an adjustable length and depth within a level surfaced mattress that will accommodate a pregnant woman at rest in a prone or side lying position.

* * * * *